US005452876A

United States Patent [19]

Hatcher

[11] Patent Number: 5,452,876

[45] Date of Patent: Sep. 26, 1995

[54] COPY HOLDER FOR USE IN-LINE WITH MONITOR STAND

[75] Inventor: David M. Hatcher, Buffalo, N.Y.

[73] Assignee: Posting Equipment Corporation, Buffalo, N.Y.

[21] Appl. No.: 233,647

[22] Filed: Apr. 26, 1994

Related U.S. Application Data

[63] Continuation-in-part of Ser. No. 15,685, Nov. 24, 1993, abandoned, which is a continuation-in-part of Ser. No. 934,008, Aug. 21, 1992, Pat. No. Des. 344,652.

[51] Int. Cl.[6] ..... A47B 19/00

[52] U.S. Cl. ..... 248/441.1; 248/442.2; 248/918; 400/718

[58] Field of Search ..... 248/441.1, 442.2, 248/447, 918, 639; 400/718; 108/28

[56] References Cited

U.S. PATENT DOCUMENTS

| | | | |
|---|---|---|---|
| D. 344,652 | 3/1994 | Hatcher . | |
| 2,014,176 | 9/1935 | Henderson . | |
| 4,313,112 | 1/1982 | Foster . | |
| 4,483,572 | 11/1984 | Story . | |
| 4,496,200 | 1/1985 | Hagstrom . | |
| 4,600,250 | 7/1986 | Windham | 248/639 |
| 4,624,510 | 11/1986 | Jedziniak . | |
| 4,635,893 | 1/1987 | Nelson . | |
| 4,717,112 | 1/1988 | Pirkle . | |
| 4,735,467 | 4/1988 | Wolters . | |
| 4,863,140 | 9/1989 | Schriner | 248/639 |
| 4,875,179 | 10/1989 | Gelman | 400/718 X |
| 4,893,775 | 1/1990 | Long . | |
| 4,901,972 | 2/1990 | Judd . | |
| 4,913,387 | 4/1990 | Tice | 248/639 |
| 4,972,962 | 11/1990 | Price | 248/918 X |
| 4,974,808 | 12/1990 | Ball | 248/639 |
| 5,062,609 | 11/1991 | Hames | 248/918 X |
| 5,104,086 | 4/1992 | Ramey . | |
| 5,213,401 | 5/1993 | Hatcher . | |
| 5,341,929 | 8/1994 | Stefancin | 248/442.2 X |

FOREIGN PATENT DOCUMENTS

| | | | |
|---|---|---|---|
| 1202478 | 8/1989 | Japan | 400/718 |

OTHER PUBLICATIONS

Brochure of Mead–Hatcher, Inc. titled "Computer Monitor Arm," catalog No. 5360, dated Apr. 10, 1993.

*Primary Examiner*—J. Franklin Foss

*Attorney, Agent, or Firm*—Hodgson, Russ, Andrews, Woods & Goodyear

[57] ABSTRACT

A copy holder which may be placed in-line vertically with a computer monitor to reduce visual fatigue and head turning. A rear edge portion of the copy holder tray is attached to fasteners which are mounted in elongate slots in the side walls for movement of the copy holder tray between a first position within the copy holder for storage of copy and a second position wherein the copy holder tray extends forwardly from the copy holder for displaying copy. The slots are elevated above a desktop so that the copy holder tray is inclined to the desktop at a comfortable predetermined angle, preferably about 22 degrees, when in the second position, with the monitor screen elevated to a comfortable viewing height. In accordance with one embodiment, the copy holder is caused to be received or rest on the shelf of a monitor stand to achieve the predetermined angle. Alternatively, the side walls of the copy holder extend to a height which achieves the predetermined angle.

20 Claims, 9 Drawing Sheets

COPY HOLDER FOR USE IN-LINE WITH MONITOR STAND

This application is a continuation-in-part of patent application Ser. No. 29/015,685, filed Nov. 24, 1993, abandoned, which is a continuation-in-part of patent application Ser. No. 07/934,008, filed Aug. 21, 1992 (now U.S. Pat. No. D344, 652), the disclosures of which are incorporated herein by reference.

The present invention relates generally to office equipment and more particularly to computer work station devices and supports. Examples of such devices are found in U.S. Pat. Nos. 2,014,176; 4,313,112; 4,483,572; 4,496,200; 4,624,510; 4,635,893; 4,717,112; 4,735,467; 4,893,775; 4,901,972; 5,104,086; and 5,213,401.

Typically, a computer support is provided for use on a desk top or other surface which would normally receive a typewriter or other similar office equipment. In U.S. Pat. No. 5,213,401 to myself, which is assigned to the assignee of the present invention and the disclosure of which is incorporated herein by reference, a computer monitor support, which elevates the monitor to a more comfortable viewing height, contains a keyboard support which slides out for use by means of fastener assemblies mounted to slide within horizontal grooves in the side walls thereof. Vertical slots connect to ends of these slots to allow the keyboard holder to be inclined when removed from within the monitor support.

The elevation of a computer screen to a more comfortable viewing height by means of a monitor stand can assist the operator in maintaining correct seated posture, thereby providing relief from back and neck fatigue. Typically, a monitor stand may comprise a shelf raised to a desired height by a vertical member or by a vertical height adjusting cylinder which is mounted to a desktop. The platform support or base of the monitor rests on the shelf. A pair of side flanges extend upwardly from the shelf, the shelf being sized or the distance between the side flanges adjustable so that the platform support rests snugly between the side flanges.

Copy holders have traditionally been placed to the side of the monitor and keyboard, requiring repeated turning of the head which can result in visual fatigue and neck and back pain.

It is considered desirable to provide copy in-line with the computer monitor to reduce head turning and visual fatigue. For example, an in-line copy holder may be desired for computer operators processing high volumes of documents and for telemarketing operators entering catalog orders directly from a telephone.

It is accordingly an object of the present invention to provide a copy tray in-line with a computer screen elevated to a comfortable viewing height.

It is a further object of the present invention to be able to incline the copy tray at a comfortable viewing angle.

It is a still further object of the present invention to be able to stow the copy out of the way when not in use.

In accordance with the present invention, a copy holding tray is positionable within a housing and mounted by means of fasteners attached to a rear edge portion of the tray and mounted in elongate slots respectively in the housing side walls, the slots extending generally parallel to the top wall of the housing. The tray is movable between a first position wherein the tray is disposed within the housing and a second position wherein the tray is disposed to extend forwardly from the housing for displaying copy. The slots are elevated above the desktop such that the tray is inclined to the desktop at a predetermined angle when in the second position for viewing copy.

The above and other objects, features, and advantages of the present invention will be apparent in the following detailed description of the preferred embodiments thereof when taken in conjunction with the accompanying drawings wherein the same reference numerals denote the same or similar parts throughout the several views.

DETAILED DESCRIPTION OF THE PREFERRED EMBODIMENTS

Figure 1:
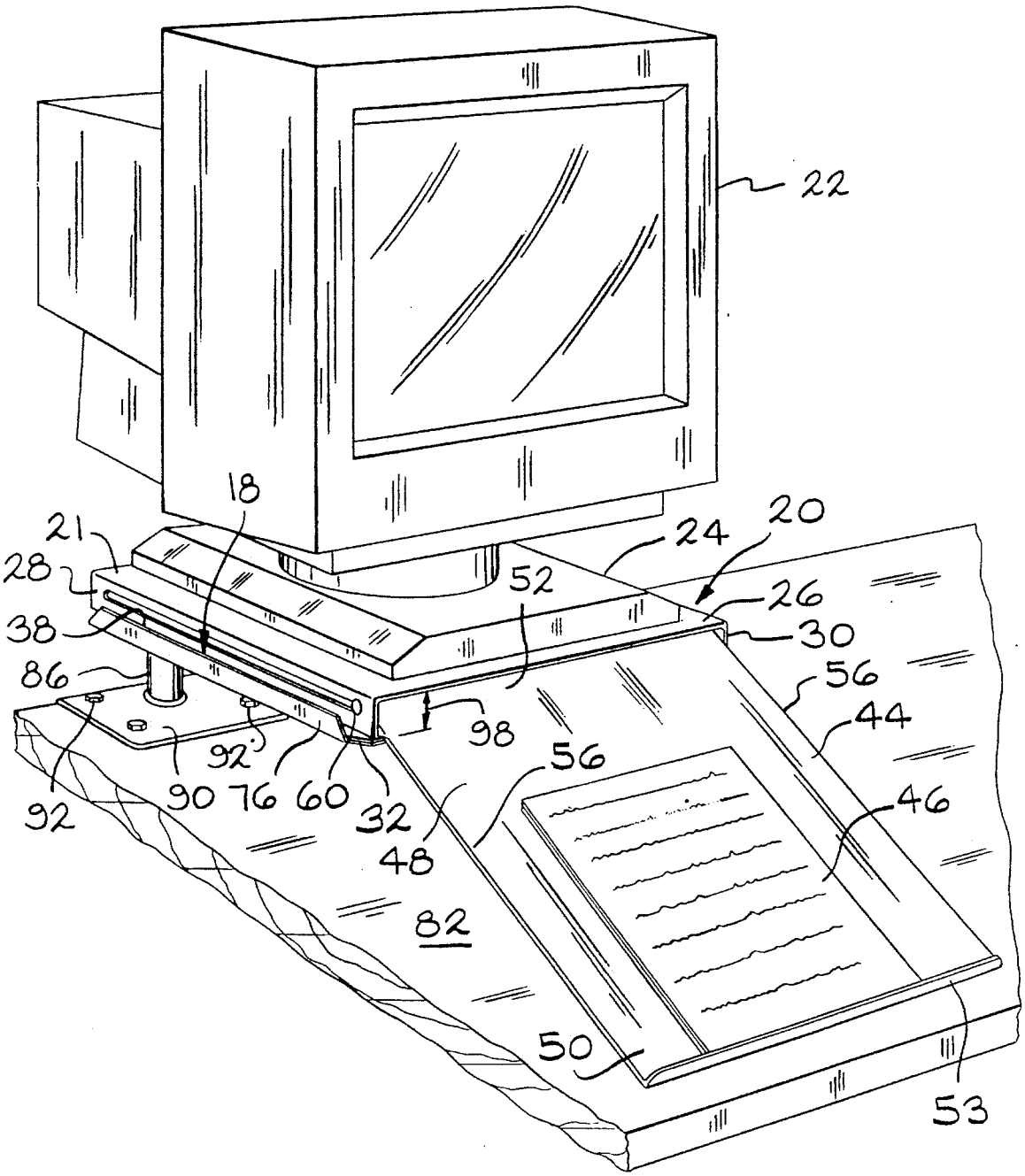
FIG. 1 is a perspective view of apparatus which embodies the present invention with a monitor mounted thereon and showing a copy tray extended from the front side thereof.

Referring to FIGS. 1 to 4, there is shown generally at 18 a conventional monitor stand or monitor arm which has a shelf 32 on which is conventionally mounted a conventional computer monitor 22 having a platform support 24. Such a conventional mounting of the platform support to rest directly on the shelf is not shown in the drawings. The platform support is conventionally snugly mounted between a pair of upstanding shelf side flanges 76, the width of shelf 32 perhaps being adjustable for achieving the desired snugness. One or more elongate support beams or cylinders 86 are suitably attached at the upper end such as by plate 88 and perhaps four rivets 94 to the shelf 32 and extend downwardly therefrom and are suitably attached at the lower end such as by plate 90 and perhaps four bolts 92 to a desktop 82. Although only one beam 86 is shown, it is understood that two such beams 86 are provided for the apparatus of FIGS. 1 to 4. The cylinders 86 are provided to elevate the shelf 32 to achieve a comfortable viewing height of the monitor 22 and therefore may desirably be height-adjustable. The provision of the beams 86 at the rear of the monitor stand 18 allows a storage area, illustrated at 96, for providing convenient access to reference documents or supplies. Such a monitor stand is marketed by MeadHatcher, Inc. of Buffalo, N.Y., an affiliate of the assignee of the present invention. Since such a monitor stand is conventional in the art, it will not be described in greater detail herein.

It is considered desirable to position copy (documents usable with the computer monitor 22) directly between the monitor and a keyboard to reduce visual fatigue, provide relief from neck and back pain which can occur from repeated turning of the head when using traditional side-placed copy holders, and provide a handy writing surface for making notations on source documents. However, it is important that such in-line positioning of the copy not be at the sacrifice of a comfortable viewing height of the monitor. In order to achieve in-line positioning of copy while continuing to maintain a comfortable monitor viewing height, in accordance with the present invention, a copy holder, illustrated generally at 20, is provided to rest directly on the shelf 32. The copy holder 20 includes a housing 21 having a generally planar top wall 26 upon which the monitor platform support 24 is placed. In order that the comfortable viewing height of the monitor 22 not be sacrificed, the housing 21 has a pair of upright parallel generally planar side walls 28 and 30 the height of which is minimized so as to not add unduly to the monitor height. Thus, the height, illustrated at 98 in FIG. 1, of the side walls 28 and 30 is preferably less than about 2 inches, for example, 1 inch or 1 ¼ inch or 1 ¾ inch. A pair of flange portions 74 extend inwardly from the lower edges of the side walls 28 and 30 respectively. The wall portions 26, 28, 30, and 74 define front and rear openings, illustrated at 34 and 36 respectively.

Figure 4:
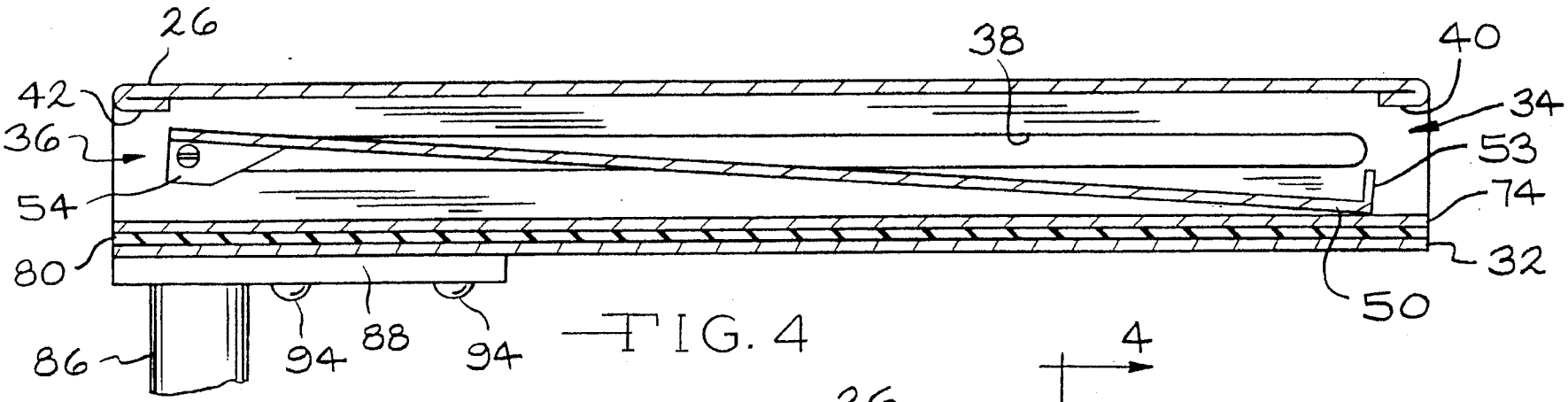
FIG. 4 is a partial sectional view thereof taken along lines 4—4 of FIG. 3 and with the copy tray stowed within the housing thereof.

Extending horizontally or parallel to the top wall 26 over substantially the length of the side walls 28 and 30 are a pair of parallel elongate slots 38. The housing 20 is suitably formed of a suitable material such as, for example, static-dissipating sheet steel. The front and rear edge portions 40 and 42 respectively of the top wall 26 are shown in FIG. 4 to be suitably doubled under.

A tray is shown at 44 for holding copy, illustrated at 46. The tray 44 comprises a generally rectangular planar portion 48 on which the copy 46 lies. Portion 48 has forward and rear end portions 50 and 52 respectively and is sized to be positionable in the space above the bottom flanges 74, below the top wall 26, and between the side walls 28 and 30 so that copy 46 placed on the planar tray portion 48 may be generally hidden from view within the housing 21 when not being used. The width of the planar portion 48 is thus equal approximately to the distance between the side walls 28 and 30, and its length is equal approximately to the length of side walls 28 and 30.

The tray 44 is composed of a material similar to that of which housing 21 is composed which sheet metal is bent along front edge portion 50 to form an upstanding tab 53 which extends generally at a right angle to portion 48 over the length of the forward end 50 to act as a stop for papers 46 placed on the tray 44 and to provide a handle for grasping the tray 44 for movement thereof into and out of the housing 21 as well as to provide a wrist support. The tab width (height) is such as to allow retention on the tray 44 of a desired thickness of papers.

The tray 44 is also formed at the rear end 52 to have a pair of ear portions 54 which are welded to and extend generally downwardly from the side edges 56 respectively of the planar portion 48 at generally right angles thereto. The ears 54 may of course be integral with the planar portion 48 or otherwise suitable attached thereto. Each of the ear portions 54 contains an aperture, illustrated at 58.

Figure 2:
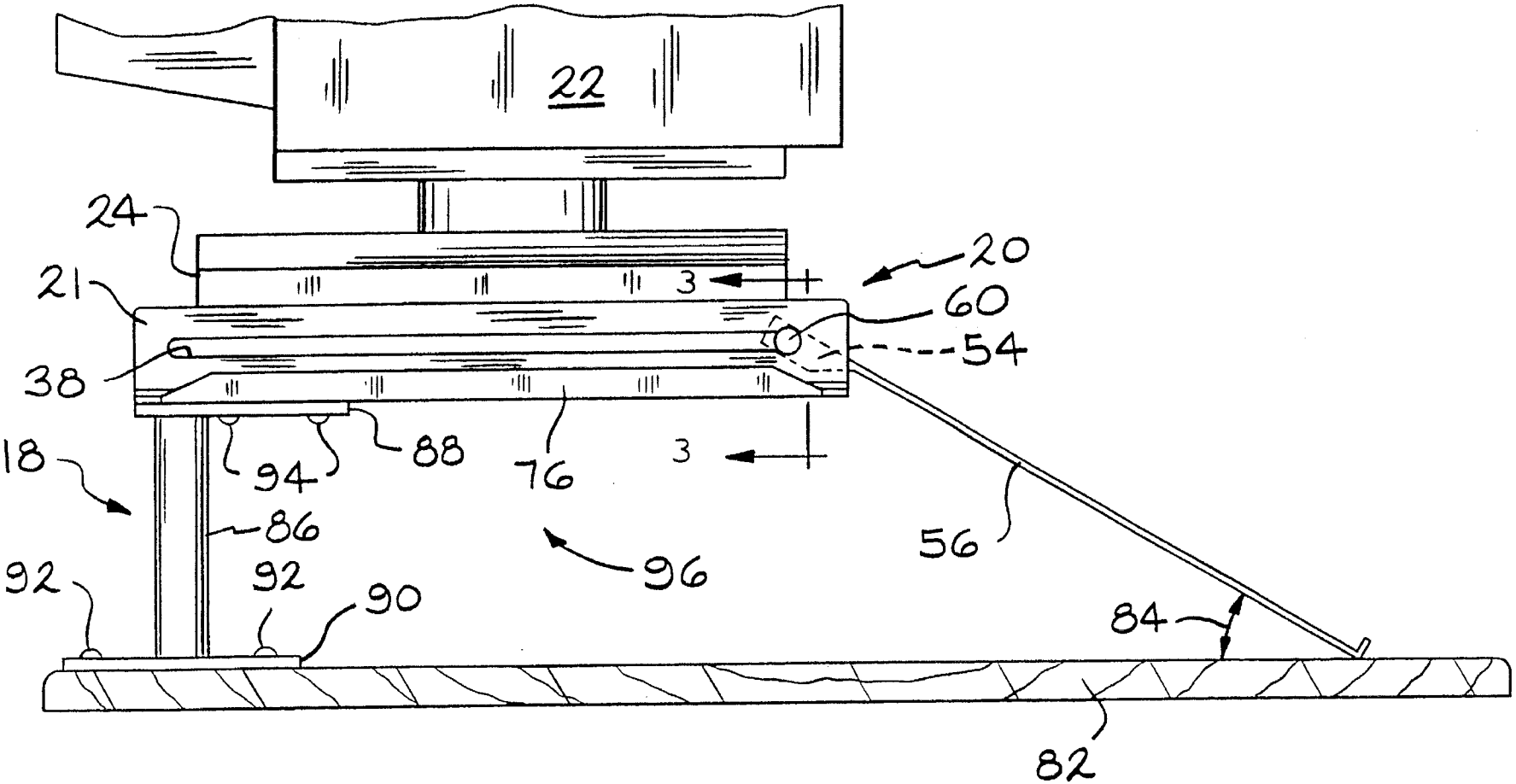
FIG. 2 is a partial side view thereof.

A fastener or pin, illustrated at 60, is receivable in each aperture 58 and the corresponding slot 38 to connect the rear end portion 52 of the tray 44 with the housing 21 for sliding movement of the rear end portion 52 of the tray 44 along the length of the slots 38 for movement of the tray 44 between a first position, illustrated in FIG. 4, wherein the tray 44 is disposed within the housing 21 with the forward end 50 resting on the flange portions 74 and a second position, illustrated in FIGS. 1 and 2, wherein the tray 44 is disposed to extend forwardly from the housing 21 for displaying copy 46. The pin 60 is composed as a single piece of a self-lubricated plastic material having a generally flat head 62 for engaging the outer surface of the respective side wall and a longitudinally split shank portion 64 to be received in the corresponding slot 38 and aperture 58. The two parts of the shank 64 have enlarged end portions 66 which together form a head which engages the inner surface of the respective ear portion 54. The split parts of the shank 64 are squeezed together to allow passage of the head portions 66 through the corresponding slot 38 and aperture 58 for easily and quickly inserting or removing the pin 60. The tray 44 is sized so that the ear portions 54 are spaced slightly from the side walls 28 and 30 so as not to slide against the side walls or otherwise interfere with movement of the tray relative to the side walls. The slot width is greater than the shank diameter to allow free play of the pin 60 relative to the slot 38 so that the self-lubricating pin 60 slides along the length of the slot 38 easily and without binding.

Figure 3:
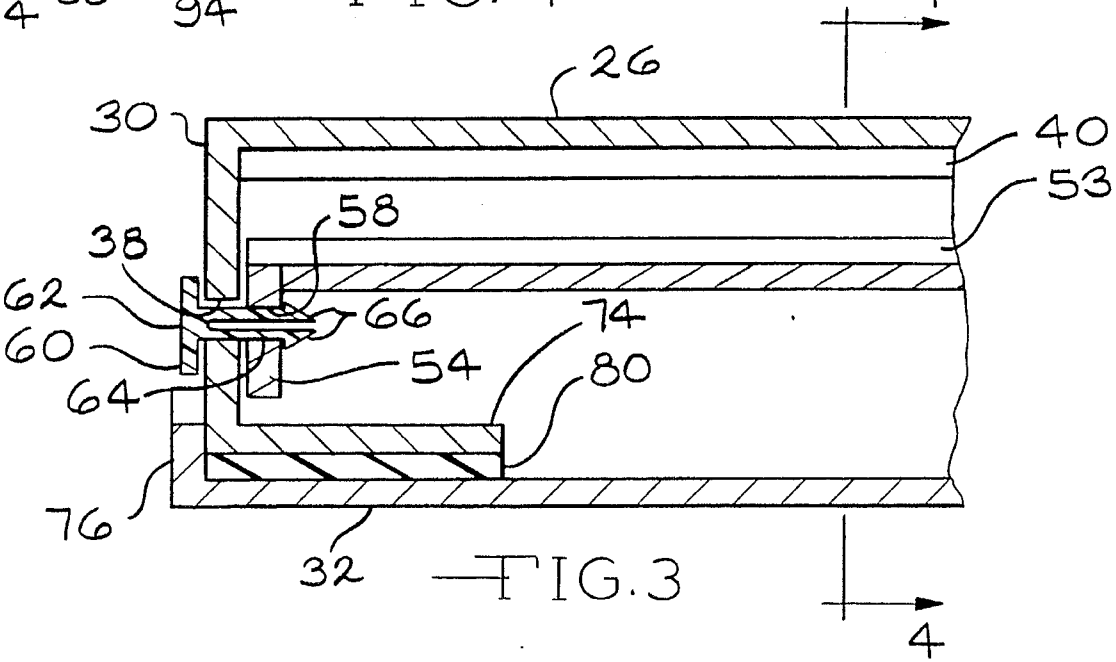
FIG. 3 is a partial sectional view thereof taken along lines 3—3 of FIG. 2.

As shown in FIG. 3, the housing 21 including the top wall 26, side walls 28 and 30, and flange portions 74 may be formed of a single piece of sheet steel or other suitable material. Felt pads 80 or the like may be interposed between the flange portions 74 and the shelf 32 for cushioning. It should be understood that copy holder 20 may be suitably formed in various other ways including the use of alternative fasteners.

In accordance with the present invention, the monitor stand 18 elevates the slots 38 above the desktop 82 upon which the monitor 22 is to be mounted such that the tray 44, when in the second position, is inclined to the desktop 82 at a suitable angle, illustrated at 84, for viewing of the copy 46.

By way of example and not for purposes of limitation, the copy holder 20 may have a width of perhaps about 11 ⅞ inches, a depth (front to rear) of perhaps about 11 ⅞ inches, and a height, illustrated at 98, of perhaps about 1 inch. These dimensions will of course be dependent on the sizes and quantity of documents to be used with the monitor. The copy holder 20 may be coated with perhaps a pearl gray epoxy coating compatible with hardware and office surroundings. The copy holder 20 may be constructed to be of sufficient strength, in accordance with principles commonly known to those of ordinary skill in the art to which this invention pertains, to support a monitor 22 having a weight of perhaps about 100 pounds. The tab width (height) may perhaps be about ⅜ inch allowing a stack of data entry or reference documents up to perhaps about ¾ inch in thickness to be stored or displayed. The slots 38 are elevated to a height above the desktop 82 of perhaps between about 5 and 6 inches so that the tray 44 may be inclined at a comfortable viewing angle 84 of perhaps about 22 degrees while elevating the monitor screen to a comfortable viewing height.

Figure 14:
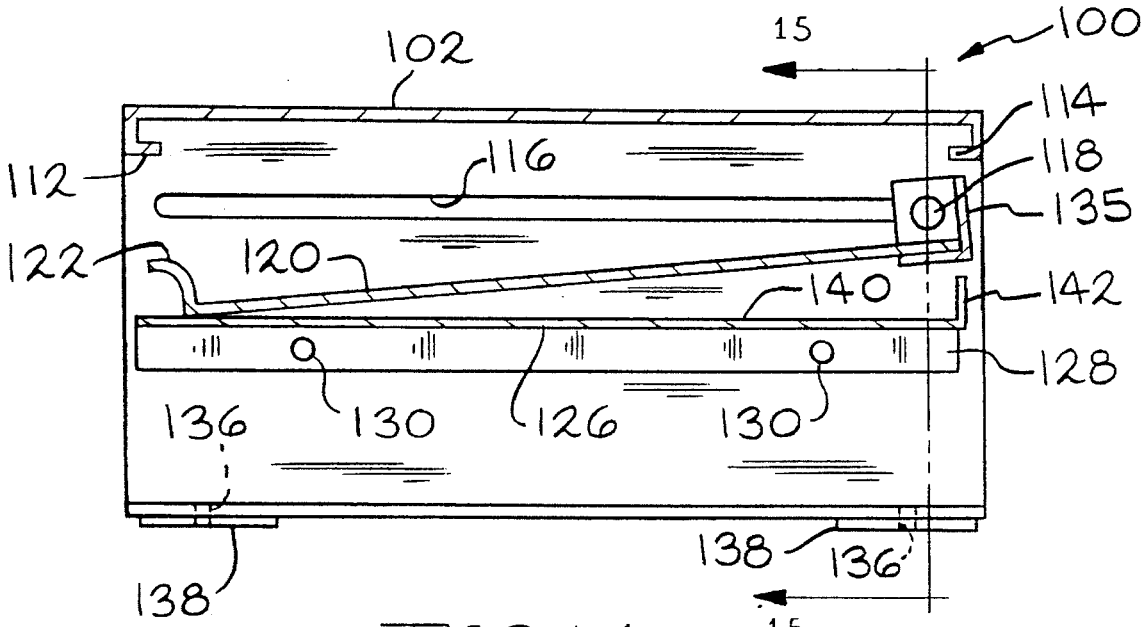
FIG. 14 is a sectional view thereof taken along lines 14—14 of FIG. 13.
Figure 15:
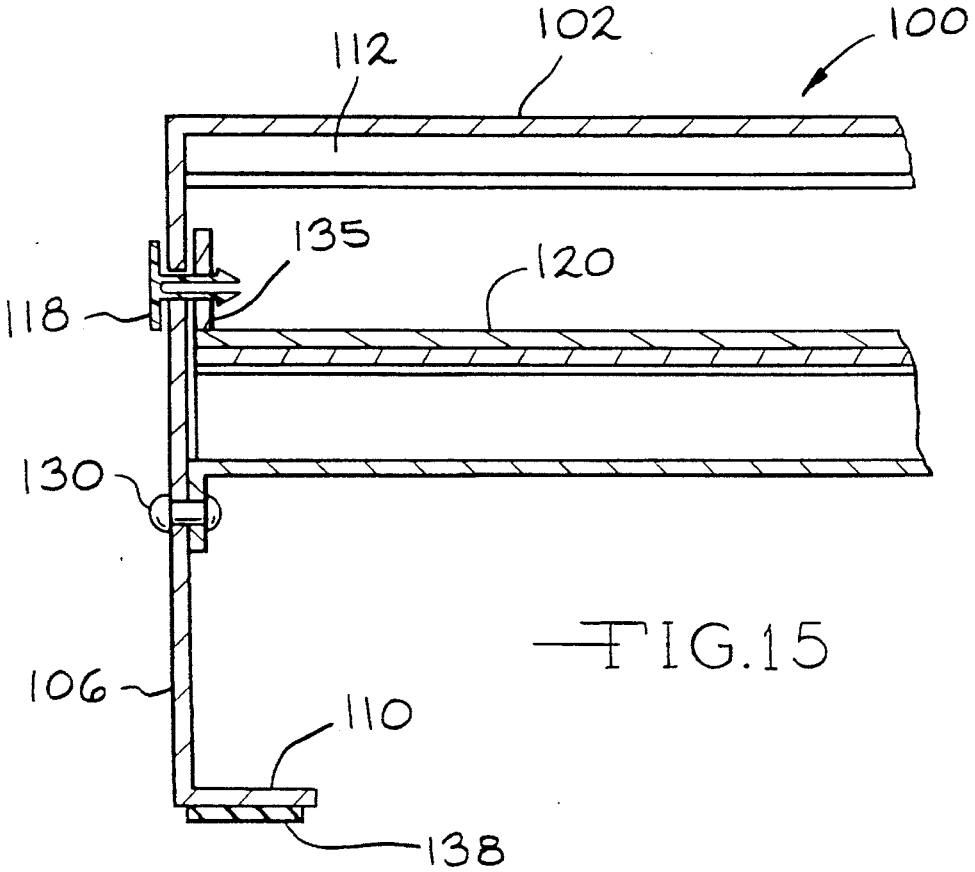
FIG. 15 is a partial sectional view thereof taken along lines 15—15 of FIG. 14.

Referring to FIGS. 5 to 15, there is shown at 100 a monitor stand in accordance with an alternative embodiment of the present invention. Stand 100 may be composed of similar material as that of which copy holder 20 is composed which material is formed to provide a top wall 102 for supporting the monitor 22, a pair of side walls 104 and 106, and a pair of narrow terminal flange portions 108 and 110 extending inwardly from the bottom edges of the side walls 104 and 106 respectively and being parallel to the top wall 102. The front and rear edge portions 112 and 114 respectively of the top wall 102 may be folded under, as shown in FIG. 14, or may alternatively have downwardly extending tab portions. The side walls 104 and 106 have a pair of elongate slots 116 similar to slots 38.

Mounted to the slots 116 by means of pins 118, similar to pins 60, is a copy tray 120 having on its forward end a upwardly and outwardly curved tab 122, which is otherwise similar to tab 53. A tab portion 134 extends upwardly from the rear end of the tray 120 to restrain papers from falling off the rear of the tray. If desired, a similar tab portion may be provided on the rear end portion 52 of tray 44. The pins 118 are received in ear portions 135, which may be similar to ears 54. The ear portions 135 may be provided by a separate sheet of material which is suitably attached such as by welding to the underside of tray 120 and is formed to have the ear portions 135 project uprightly from the respective sides of the tray 120.

Figure 5:
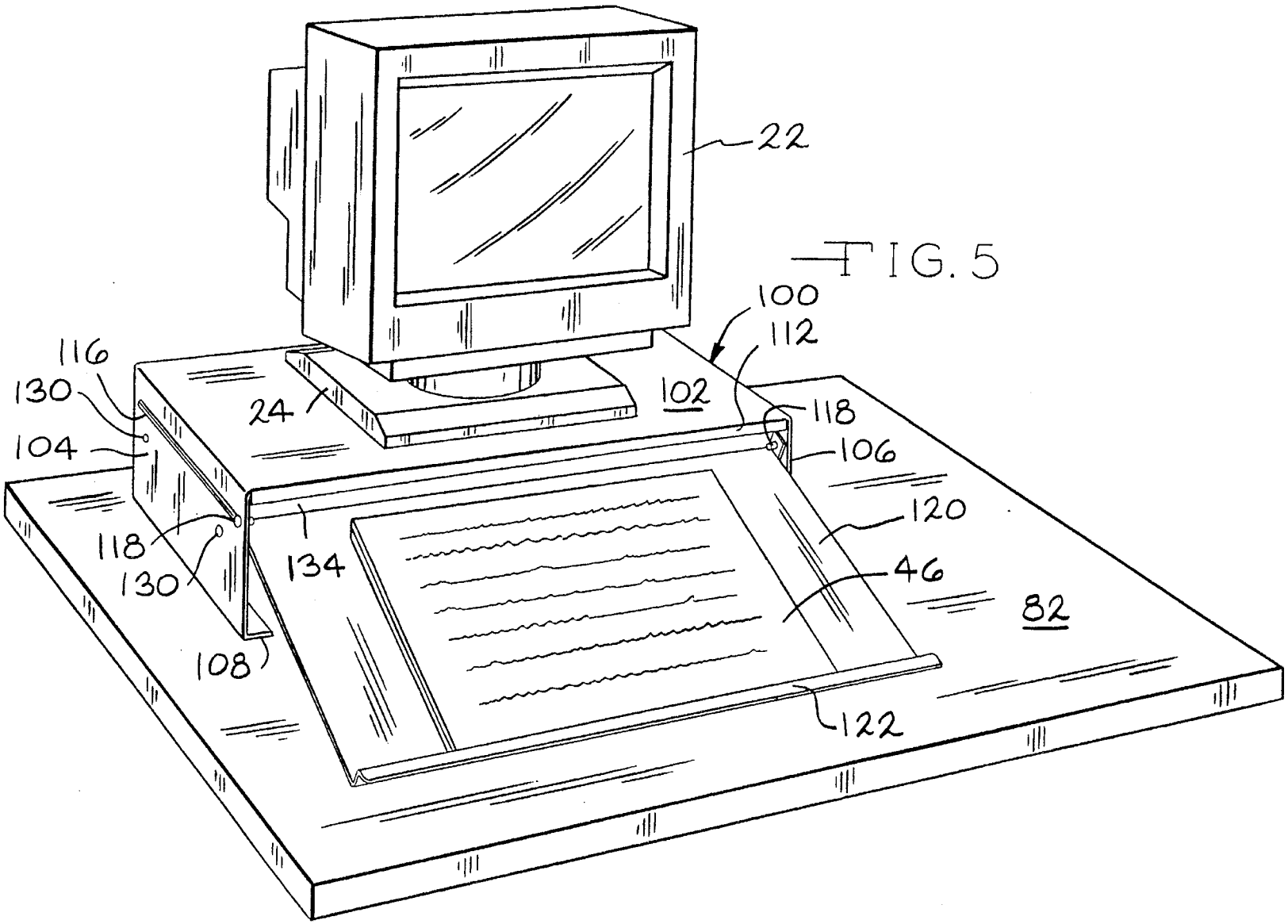
FIG. 5 is a perspective view of apparatus in accordance with an alternative embodiment of the present invention with a monitor mounted thereon and showing a copy tray extended from the front side thereof.
Figure 6:
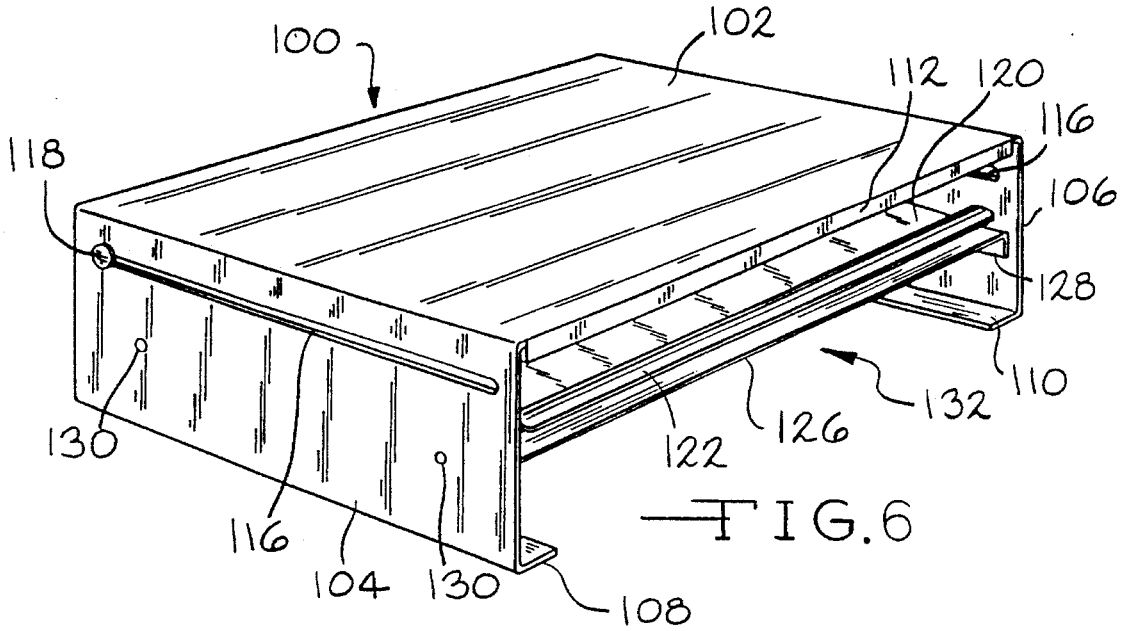
FIG. 6 is a perspective view of the apparatus showing the copy tray stowed within the housing thereof.
Figure 7:
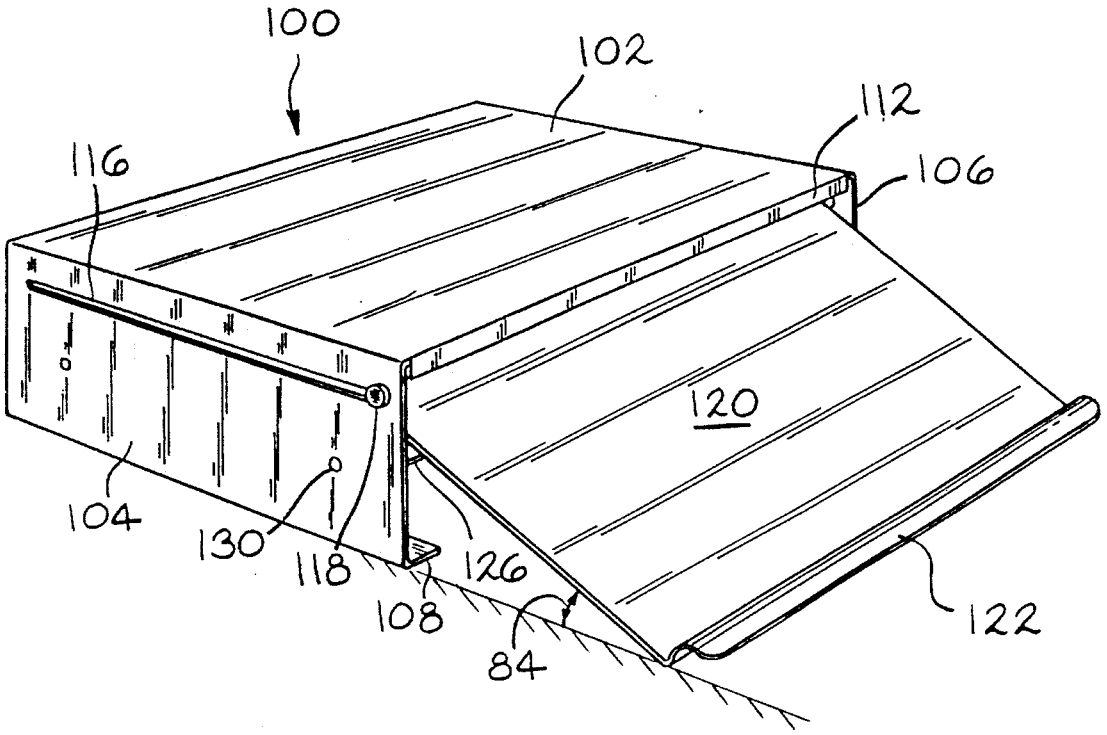
FIG. 7 is a perspective view of the apparatus showing the copy tray extended from the front side of the housing.
Figure 8:
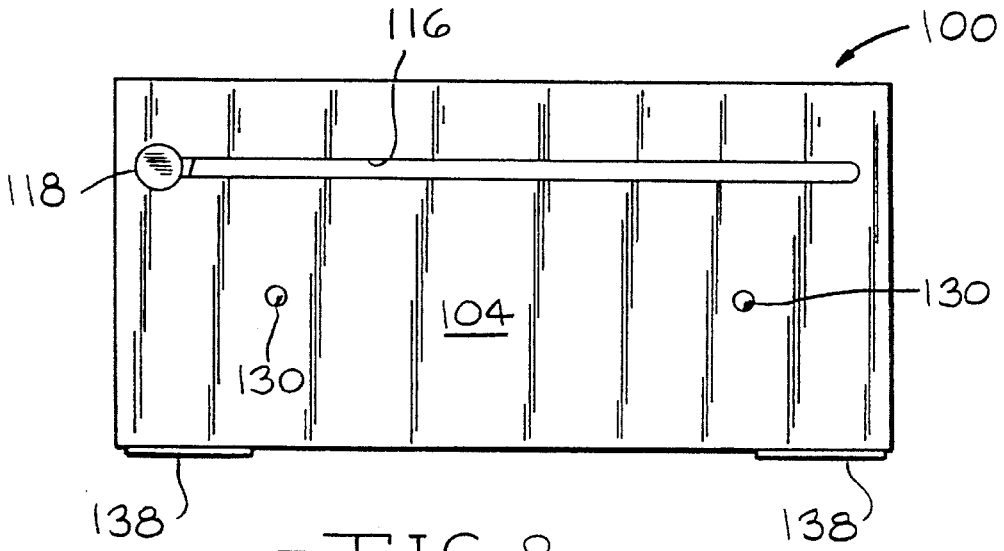
FIG. 8 is a left side elevational view thereof.
Figure 9:
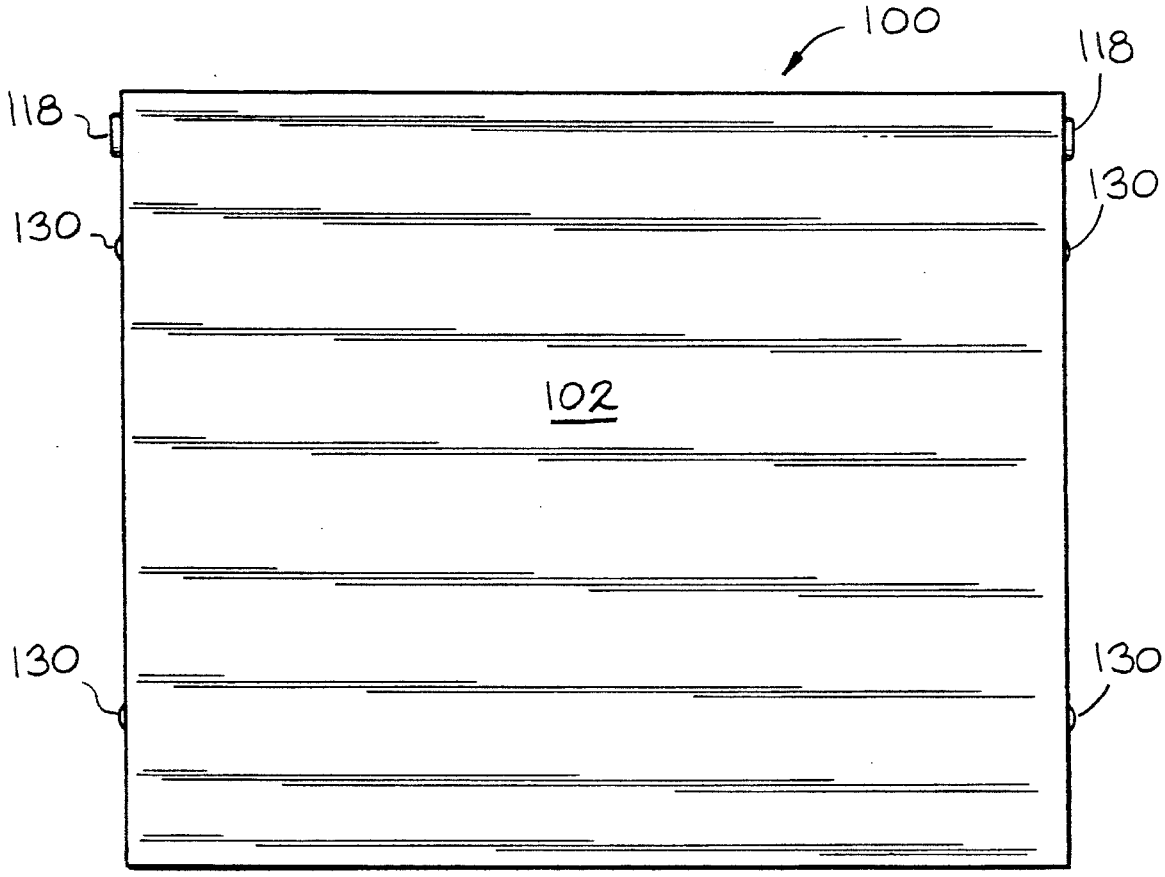
FIG. 9 is a top plan view thereof.
Figure 10:
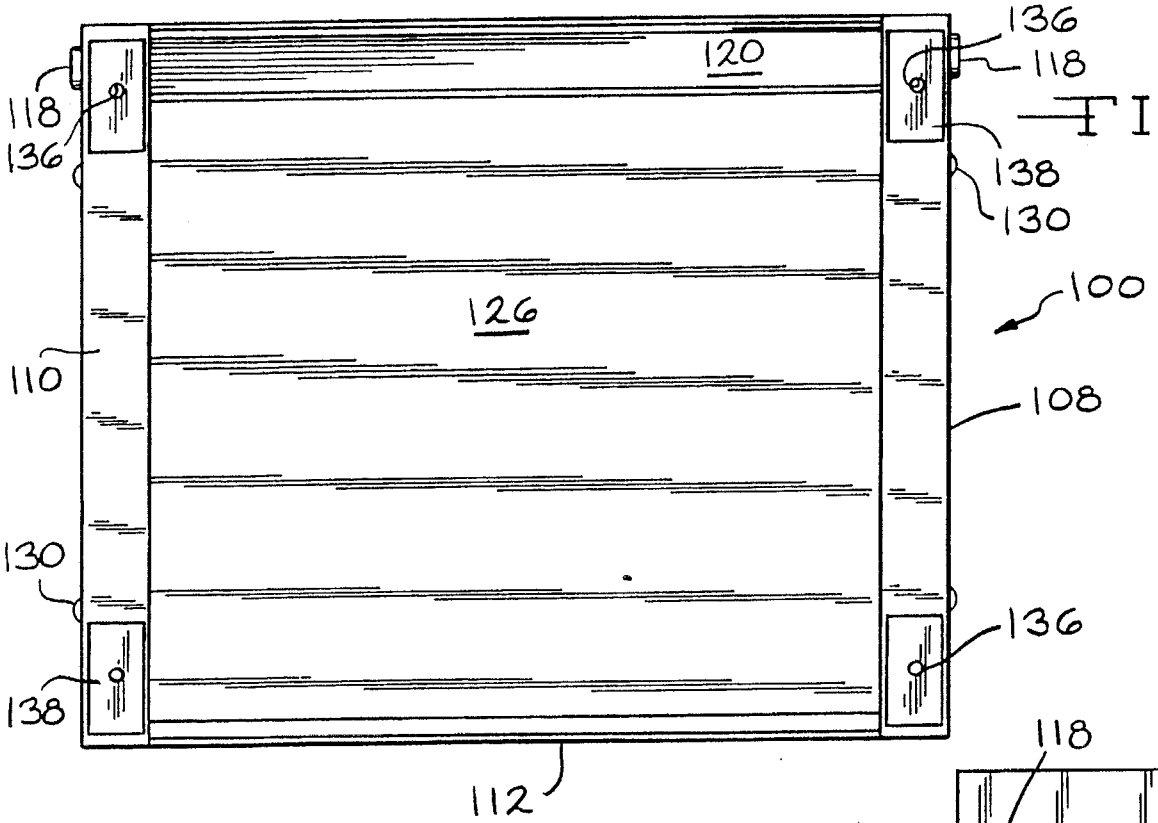
FIG. 10 is a bottom view thereof.
Figure 11:
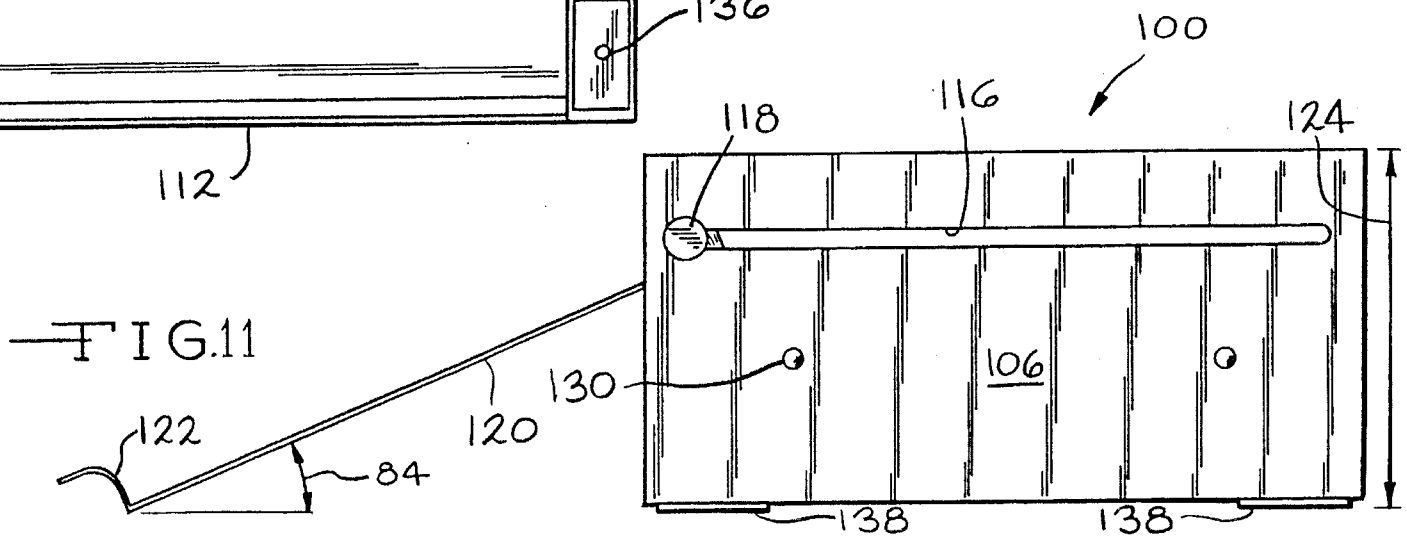
FIG. 11 is a right side elevational view thereof, the copy tray shown extended from the front side.
Figure 12:
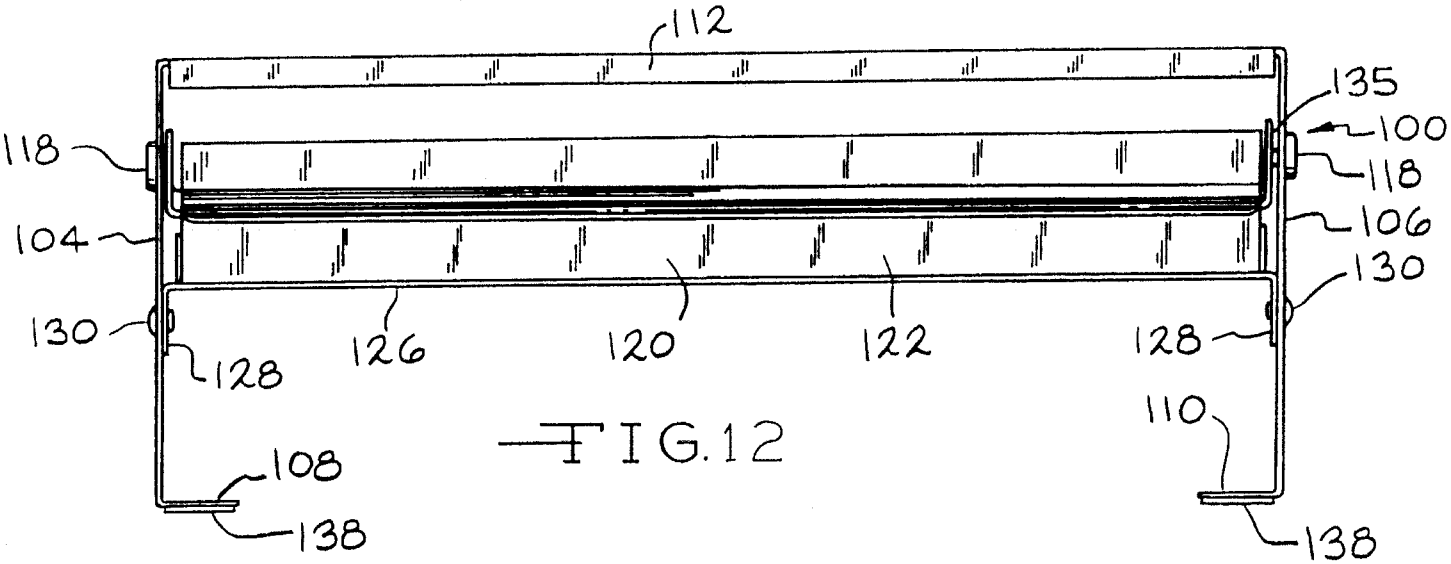
FIG. 12 is a front elevational view thereof.
Figure 13:
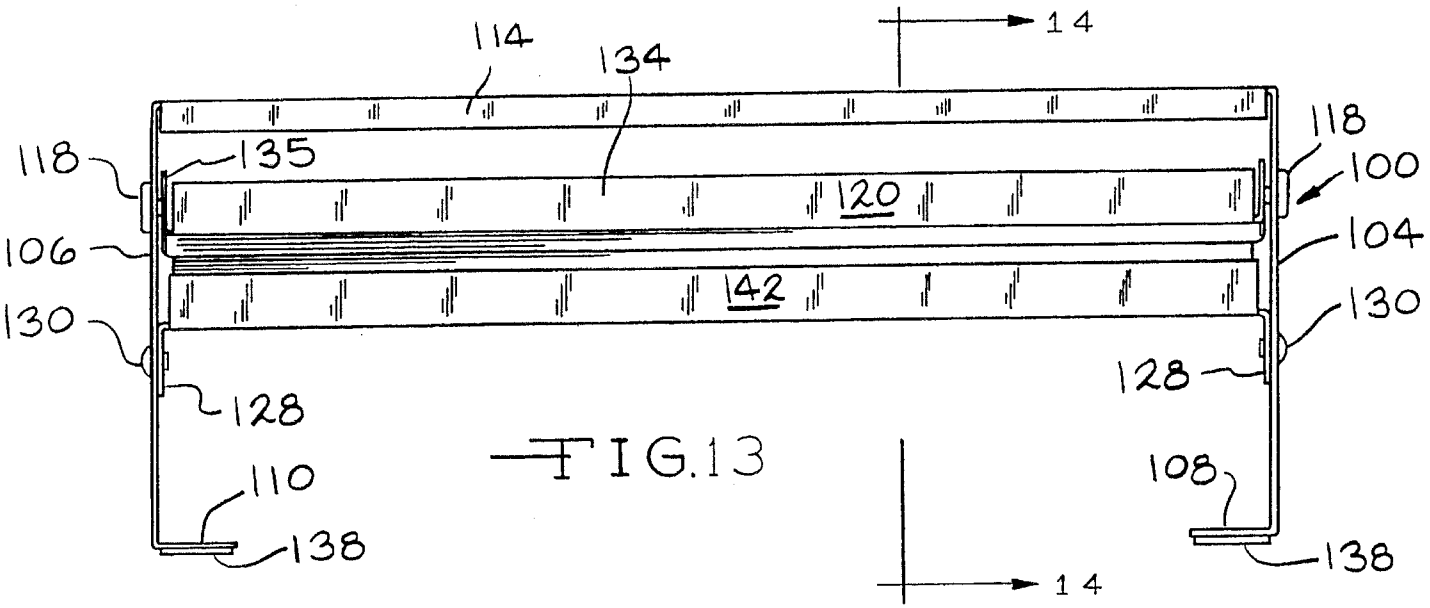
FIG. 13 is a rear elevational view thereof.

In accordance with the embodiment shown in FIGS. 5 to 15, the slots 116 are suitably elevated to provide the desired viewing angle 84 when the tray 120 is in the second position withdrawn from the stand 100, as shown in FIGS. 5 and 7, by selecting a suitable height, illustrated at 124 in FIG. 11, of the side walls 104 and 106. For example, the side wall height 124 may perhaps be about 6 inches providing an elevation of the lower edges of the slots 116 above the desktop 82 of perhaps about 4 ½ inches to achieve a desired viewing angle 84 of perhaps about 22 degrees as well as to elevate the monitor 22 to a comfortable viewing height. The flanges 108 and 110 may be detachably attached to the desktop 82 by means of felt pads 138 adhesively attached to the bottom surfaces of the flanges 108 and 110 and by means of apertures, illustrated at 136, in the flanges 108 and 110 and the pads 138 for receiving bolts (not shown) or by other suitable means.

A ledge or support member for the tray 120 when in the first position within the stand 100 is shown as 126 in FIG. 6. The ledge 126 comprises a plate providing a generally planar surface 140 and formed to have a pair of downwardly extending side flanges 128 which are attached to the side walls 104 and 106 by rivets 130 or other suitable means and further having an upstanding tab portion 142 extending upwardly from its rear edge. The space between the ledge 126 and the desktop 82 provides a storage area, illustrated at 132, for convenient access to reference documents or supplies.

By way of example and not for purposes of limitation, the planar surface of tray 120 may perhaps be about 14 to 23 inches wide and about 13 inches deep (front to rear) to accommodate similarly-sized documents. Rear tab 134 may have a height of perhaps about ¾ inch, and front wrist support/tab 122 may have a height of perhaps about 1 inch. Support plate or ledge 126 is located perhaps about 3 ¼ inches below the top wall 102. The upper edges of the slots 116 may be perhaps about 1 ¼ inch below the top wall 102. Portions 112 and 114 may extend downwardly from the top wall 102 a distance of perhaps about ¼ inch. Such a monitor stand 100 may accommodate a stack of documents 46 to a height of perhaps about 1¾ inch and may be provided to support a monitor having a weight of perhaps about 100 pounds.

Thus, a copy holder, which may include a sight guide (not shown), is provided in accordance with the present invention to be in-line with a monitor for use, for example, by computer operators processing high volumes of documents and for telemarketing operators entering catalog orders directly from the telephone. The combination is provided to (1) elevate or maintain elevation of the computer screen to a comfortable viewing height, assisting the operator in maintaining correct seated posture to thereby provide relief from back and neck fatigue, and (2) place data entry or reference documents in direct line between the keyboard and the computer screen at a comfortable viewing angle of perhaps about 22 degrees. With the copy being in-line vertically with the monitor thereby requiring primarily vertical eye movement, visual fatigue and head turning usually associated with conventional copy holders may be reduced. Further, when not in use, the in-line copy holder easily slides into the monitor stand for storage of a stack of documents to aid in maintaining a neater work space. Thus, the in-line copy holder of the present invention is provided for operator convenience, comfort, and efficiency.

It should be understood that, while the invention has been described in detail herein, the invention can be embodied otherwise without departing from the principles thereof, and such other embodiments are meant to come within the scope of the present invention as defined by the appended claims.

What is claimed is:

1. A combination monitor stand and copy holder, the combination comprising a housing including a generally planar top wall which is adapted to support a monitor and a pair of parallel side walls extending downwardly from said top wall, a pair of elongate slot means in said sidewalls respectively and extending generally parallel to said top wall, a tray adapted for holding copy and having a forward edge portion and a rear edge portion and positionable below said top wall and between said side walls, means for mounting said tray to said side walls comprising fastener means attached to said rear edge portion of said tray and mounted in said slot means respectively for sliding movement therein for movement of said tray between a first position wherein said tray is disposed within said housing and a second position wherein said tray is disposed to extend forwardly from said housing for displaying copy, and means for elevating said slot means above a desktop such that said tray is inclined to the desktop at a predetermined angle when in said second position for viewing copy on the tray.

2. A combination according to claim 1 wherein said elevating means comprises a shelf adapted for supporting said housing, at least one support member attached to said shelf to extend downwardly therefrom, and means for attaching said support member to a desktop.

3. A combination according to claim 2 wherein said housing includes bottom wall means for supporting said tray when in said first position.

4. A combination according to claim 2 further comprising an upstanding tab portion on said forward edge portion of said tray for retaining copy on said tray and providing a handle and wrist support.

5. A combination according to claim 2 wherein said at least one support member extends over a distance downwardly from said shelf such that said predetermined angle is about 22 degrees.

6. A combination according to claim 2 wherein said housing has a height which is equal to less than about 2 inches.

7. A combination according to claim 1 wherein said side walls have a height such that said tray is inclined to the desktop at said predetermined angle when in said second position.

8. A combination according to claim 7 further comprising ledge means for supporting the copy holder when in said first position, said ledge means defining a storage space below said ledge means and between said side walls.

9. A combination according to claim 7 wherein said side wall height is equal to about 6 inches.

10. A combination according to claim 7 wherein said elevating means comprises means for elevating said slot means from the desktop a distance of about 4 ½ inches.

11. A combination according to claim 7 wherein said tray further comprises an upstanding tab portion on said forward edge portion of said tray for retaining copy on said tray and providing a handle and wrist support and further comprises an upstanding tab portion on said rear edge portion of said tray for retaining copy on said tray.

12. A combination according to claim 7 wherein said side wall height is such that said predetermined angle is about 22 degrees when said tray is in said second position.

13. A combination according to claim 1 wherein said tray further comprises an upstanding tab portion on said forward edge portion of said tray for retaining copy on said tray and providing a handle and wrist support.

14. A combination according to claim 1 wherein said elevating means comprises means for elevating said slot means above the desktop such that said predetermined angle is about 22 degrees.

15. A combination according to claim 1 wherein said elevating means comprises means for elevating said slot means from the desktop a distance of about 4 ½ inches.

16. A combination according to claim 1 further comprising a monitor mounted on said top wall and copy disposed on said tray whereby the copy is in-line vertically with said monitor.

17. For use with a monitor stand having a shelf elevated above a desktop, a copy holder comprising a housing adapted to rest on a monitor stand shelf and including a generally planar top wall which is adapted to support a monitor and a pair of parallel side walls extending downwardly from said top wall over a height which is less than about 2 inches, a pair of elongate slot means in said sidewalls respectively and extending generally parallel to said top wall, a tray adapted for holding copy and having a forward edge portion and a real edge portion and positionable below said top wall and between said side walls, an upstanding tab portion extending from said forward edge portion for retaining copy on said tray, means for mounting said tray to said side walls comprising fastener means attached to said rear edge portion of said tray and mounted in said slot means respectively for sliding movement therein for movement of said tray between a first position wherein said tray is disposed within said housing and a second position wherein said tray is disposed to extend forwardly from said housing and downwardly to a desktop on which the monitor stand is mounted to be inclined to the desktop at an angle for viewing copy on the tray.

18. A copy holder according to claim 17 further comprising an upstanding tab portion extending from said rear edge portion for retaining copy on said tray.

19. A copy holder according to claim 18 further comprising bottom wall means for supporting said tray when in said first position.

20. A copy holder according to claim 17 further comprising bottom wall means for supporting said tray when in said first position.

* * * * *